US008596184B2

(12) United States Patent
Lindskog

(10) Patent No.: US 8,596,184 B2
(45) Date of Patent: Dec. 3, 2013

(54) AUTOMATIC CHARGE MAGAZINE

(75) Inventor: Lars-Olov Lindskog, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 0 days.

(21) Appl. No.: 13/503,140

(22) PCT Filed: Oct. 19, 2010

(86) PCT No.: PCT/SE2010/000249

§ 371 (c)(1),
(2), (4) Date: Jun. 28, 2012

(87) PCT Pub. No.: WO2011/049503

PCT Pub. Date: Apr. 28, 2011

(65) Prior Publication Data

US 2012/0266748 A1 Oct. 25, 2012

(30) Foreign Application Priority Data

Oct. 21, 2009 (SE) ..... 0901360

(51) Int. Cl.
*F41A 9/00* (2006.01)

(52) U.S. Cl.
USPC ..... 89/45; 89/1.4; 89/33.01; 89/33.1

(58) Field of Classification Search
USPC ..... 89/45, 46, 1.4, 33.01, 33.1
See application file for complete search history.

(56) References Cited

U.S. PATENT DOCUMENTS

| | | | | |
|---|---|---|---|---|
| 5,111,730 | A * | 5/1992 | Grabner | 89/45 |
| 5,111,731 | A * | 5/1992 | Grabner | 89/46 |
| 6,065,385 | A | 5/2000 | Steward et al. | |
| 6,073,534 | A | 6/2000 | Gagnon | |
| 6,205,904 | B1 | 3/2001 | Boutet et al. | |
| 7,475,626 | B2 * | 1/2009 | Grunewald | 89/45 |
| 2005/0241469 | A1 | 11/2005 | Minard et al. | |
| 2007/0151439 | A1 | 7/2007 | Van Dyke-Restifo et al. | |
| 2008/0047417 | A1 | 2/2008 | Grunewald | |
| 2009/0071321 | A1 | 3/2009 | Konicke | |

FOREIGN PATENT DOCUMENTS

| | | | |
|---|---|---|---|
| FR | 2743413 | A1 | 7/1997 |
| JP | 2006-097910 | A | 4/2006 |
| SE | 507659 | C2 | 6/1998 |
| WO | WO-99/36743 | A1 | 7/1999 |
| WO | WO-2005/116564 | A1 | 12/2005 |

* cited by examiner

*Primary Examiner* — J. Woodow Eldred
(74) *Attorney, Agent, or Firm* — Novak Druce Connolly Bove + Quigg LLP

(57) ABSTRACT

The present invention relates to an automatic charge magazine (1) for storage and handling of propellent powder charges of the modular charges and/or powder bag charges type, also termed increment charges (4), for projectiles, for example shells, which are arranged in a fireable manner, together with the increment charges (4), in an artillery gun, preferably of the vehicle-mounted artillery gun type, wherein the charge magazine (1) comprises a plurality of charge containers (5, 5', 5") arranged in a drivable revolving track, which charge containers (5, 5', 5") are arranged to assume feed-in and feed-out positions (2, 11) for the feed-in and feed-out of at least one increment charge (4) to and from the charge containers (5, 5', 5"). The invention can principally be deemed to be characterized in that the charge magazine (1) also comprises at least one ejection member (15, 31, 32, 33, 34), which ejection member, in response to control signals (i2) from the said control unit (22), ejects one or more increment charges (4) from the respective charge container (5, 5', 5")/applied in the feed-out position, to a loading tray (18) belonging to the gun.

19 Claims, 5 Drawing Sheets

AUTOMATIC CHARGE MAGAZINE

CROSS REFERENCE TO RELATED APPLICATIONS

Figure 1:
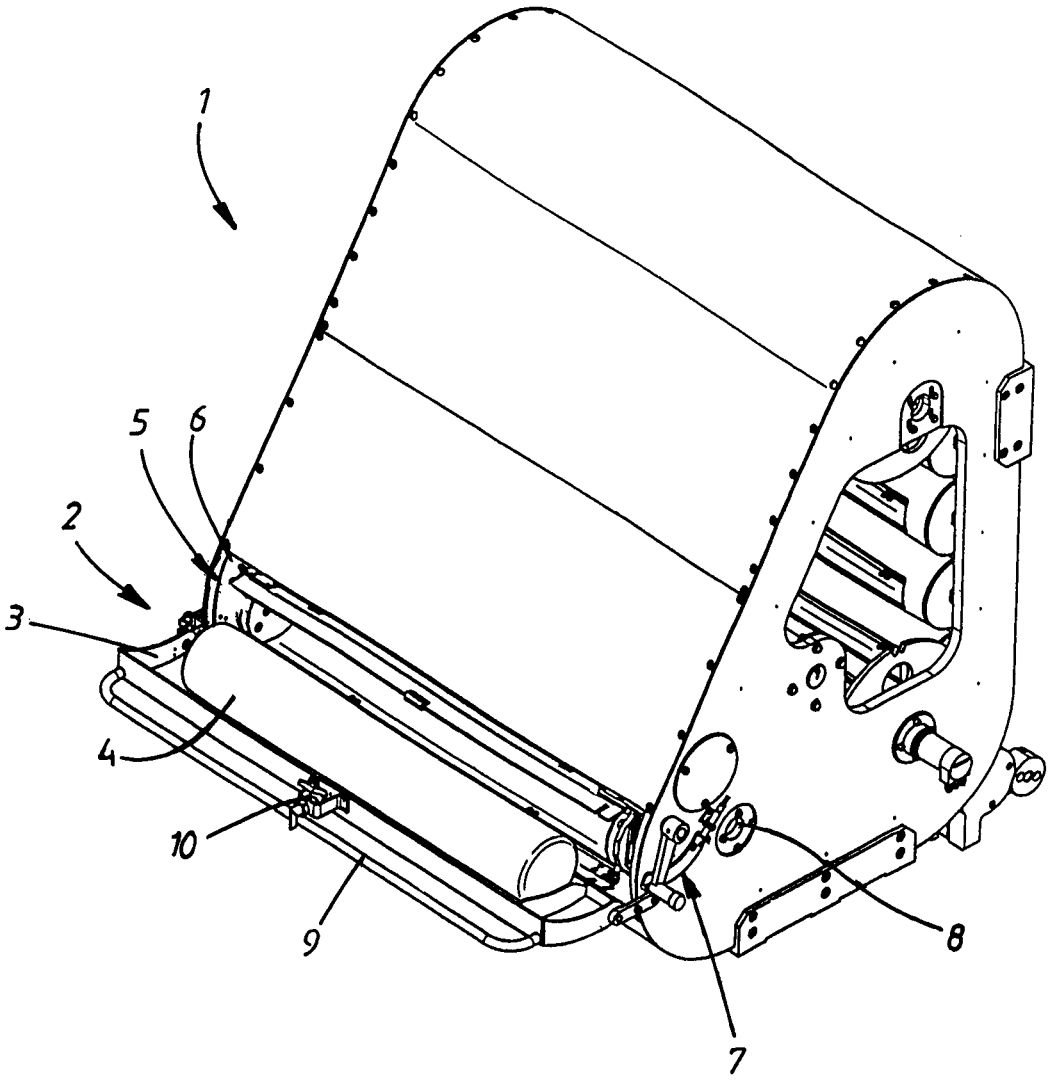

This application is a National Phase filing under 35 U.S.C. §371 of PCT/SE2010/00249 filed on Oct. 19, 2010; and this application claims priority to Application No. 0901360-8 filed in Sweden on Oct. 21, 2009 under 35 U.S.C. §119; the entire contents of all are hereby incorporated by reference.

The present invention relates to an automatic charge magazine for storage and handling of propellent powder charges of the modular charges and/or powder bag charges type, also termed increment charges, for projectiles, for example shells, which are arranged in a fireable manner, together with the increment charges, in an artillery gun, preferably of the vehicle-mounted artillery gun type. The increment charges can differ in size, number and/or type.

PROBLEM DEFINITION AND PRIOR ART

Charge systems of the kind stated in the introduction for shells which are fired with a propellent charge consisting of increment charges, i.e. propellent charges which are not bound to the shells with cartridges, but rather are applied behind the particular shell, projectile, etc. in the barrel of the artillery gun in the correct quantity, type, number, size, etc. before the gun is fired, are commonly known from the prior art. The increment charges can be of the powder bags type, in which the powder is enclosed in a combustible cloth case, or of the modular charges type, in which the powder is enclosed in rigid cardboard or plastics containers, which containers are combustible.

For present-day ammunition handling systems, it is required that shot and charge applications in the gun must proceed quickly, especially if salvos are fired from the same firearm, where shots fired in the time interval following preceding shots are expected to impact in the target area essentially simultaneously with the previously fired shot(s). This places high demands on the selection and charge functions which are exercised by the system. Moreover, there is a need to be able to increase the selection options between a plurality of increment charges and charge types in the various firings.

An example of an ammunition handling system of the said kind is described in patent specification SE 507659 C2. The ammunition handling system in SE 507659 C2 is made up of a number of parallel storage tubes, which are rotatable about a common axis and are filled with a certain number of increment powder charges, in which each of the storage tubes contains increment powder charges of one and the same charge strength, i.e. with the same powder and with the same size. At the feed-out end of the storage tubes there is arranged a charge preparation device consisting of six circular discs individually rotatable about a common axis, which discs are provided with cutouts or openings of a size corresponding to the size of the increment charges.

The charge preparation device is arranged such that the common axis of the discs coincides with the common axis of the storage tubes. When the discs are rotated such that two or more of the cutouts of the discs end up in line with one another and in line with the particular storage tube, the transfer of increment charges from the storage tube to the charge preparation device, corresponding to the number of cutouts which are in line, is enabled. The transfer of the increment charges is realized by a hooked ejector being driven along the storage tube, which is slotted, whereupon the hook drives or pushes the increment charges before it into the cutouts. After this, a further transfer of the increment charges from the charge preparation device to a parallel-situated loading pendulum, in the radial direction, is realized, wherein a second radial ejector is used. Finally, the loading pendulum moves the increment charges to the charge opening of the gun. The whole procedure is repeated for each new propellent charge.

One problem with the said ammunition system is the complexity of the system, involving a large number of moving parts which have to be coordinated. The discs are driven individually relative to one another, which requires separate, high-precision rotary gear in order to avoid faults.

Furthermore, the system contains two ejection mechanisms, an axial ejection mechanism between storage tubes and charge preparation device and a radial ejection mechanism between charge preparation device and loading pendulum, which makes the system slow and increases the risk of malfunction. The object of the present invention is to solve, inter alia, these problems.

There is also a need for the charge magazine to be produced with clear functions which guarantee rapid and refined firing functions. It is important that there is no need to complicate staff routines and that conventional ammunition handlings can otherwise be maintained with the gun despite introduction of the new ideas. Another object of the invention is to solve this problem.

OBJECT OF THE INVENTION AND ITS DISTINGUISHING FEATURES

A main object of the present invention has been to provide an automatic charge magazine for storage and handling of increment charges for projectiles, for example shells, which are arranged in a fireable manner, together with the increment charges, in an artillery gun, preferably of the vehicle-mounted artillery gun type, having few moving parts, high transfer speed and high functional reliability, in which the risk of an interruption of fire has been heavily reduced.

These objects, as well as other purposes which have not been enumerated here, are satisfactorily met within the scope of that which is stated in the present independent patent claims.

Thus, according to the present invention, an automatic charge magazine for storage and handling of propellent powder charges of the modular charges and/or powder bag charges type, also termed increment charges, for projectiles, for example shells, which are arranged in a fireable manner, together with the increment charges, in an artillery gun, preferably of the vehicle-mounted artillery gun type, is provided, wherein the charge magazine comprises a plurality of charge containers arranged in a drivable revolving track, which charge containers are arranged to assume feed-in and feed-out positions for the feed-in and feed-out of at least one increment charge to and from the charge containers, and wherein the charge magazine is provided with or connected to a control unit arranged firstly to actuate the driving of the revolving track for adjustment of the respective charge container to the said feed-in and feed-out positions, and secondly to determine the current charge content in the respective charge container.

The invention can principally be deemed to be characterized in that the charge magazine also comprises at least one ejection member, which ejection member, in response to control signals from the said control unit, ejects one or more increment charges from the respective charge container, applied in the feed-out position, to a loading tray belonging to the gun.

According to further aspects of the automatic charge magazine according to the invention, it is the case: that control signals are chosen to give such propellent charge contents to various projectiles arranged in a fireable manner in the gun that these reach an impact area at essentially the same time, despite the fact that the gun fires them during successive time intervals, that the charge magazine is arranged with openings situated on both sides of the charge magazine, at which openings the said feed-in and feed-out positions for charge containers are arranged, that the respective charge container is arranged with an openable and closable first opening, which, when the charge container is applied in the feed-in position of the charge magazine, is essentially directed upwards to enable one or more increment charges to be deposited in the charge container, that the respective charge container is arranged, when one or more increment charges are fed out from the charge container to the loading tray of the gun, to have an opening facing towards the loading tray, which opening consists of a second opening arranged on the opposite side to the first opening, that the ejection members, in the feed-out position of the charge container, are interactable with one or more increment charges for parallel displacement from the charge container down into the loading tray, that the displacement of the increment charge or propellent charges is realized via an openable hatch or openable hatches or under the influence of bracing members, for example bracing springs, that the feed-in position is situated in a protected part of the gun and/or that the feed-out position is situated in an unprotected part of the gun, and that the respective charge container is provided with openable and closable hatch parts, that the control unit is arranged, when shells are fired, to preselect charge containers in the revolving track and their given turn for adjustment to the feed-out position, that the revolving track comprises a chain conveyor and drive devices comprising a hydraulic motor, that the respective ejection member comprises a hydraulic cylinder which ejects or pushes out the respective increment charge or part of the increment charge with a longitudinal movement directed perpendicular to the longitudinal extent of the increment charge, that the respective ejection member comprises two substantially parallelly arranged ejection parts which straddle a centre shaft between two gearwheels disposed in the magazine, and that the centre shaft is parallel with the longitudinal extent of the feed-out opening, that the respective charge container assumes its feed-out position with an angle transmitter, that devices controlling the revolving track are arranged such that they are interactable with grooves on the end faces of the charge magazine, that the respective charge containers are arranged with two hatch halves, which assume open positions by virtue of the fact that they are actuated backwards along the envelope surface of the charge container counter to the action of a spring and are rotated about hinges, and that a link mechanism is arranged between the hatch halves and ensures that the hatch halves are opened simultaneously and synchronously, that the link mechanism is provided with an operating arm disposed on an outer side of the magazine, that a feed-in hatch is disposed at the feed-in opening of the magazine, and that the feed-in hatch is provided with a manually actuable portion, for example a handle, that, when the feed-in hatch is lowered, this is arranged to receive one or more increment charges, and that the hatch halves are here arranged such that they are openable by means of the said operating arm, whereafter the increment charges can be manually shoved in by means of parallel movement(s) or by means of the hatch when this is actuated into the closed position, that the interiors of the charge containers are arranged with assignable compartments situated side by side in the longitudinal directions of the charge containers, wherein the ejection members see to it that the correct number of increment charges are selected for further shots, that one or more charge containers are arranged with a first compartment corresponding to a first length of an increment charge and a second compartment corresponding to a second length of an increment charge.

ADVANTAGES AND EFFECTS OF THE INVENTION

The above-proposed produces an advantageous shell and propellent charge handling which improves the strategies in the use of the gun. The units can operate with expedient and rapid ejection devices/members, which, by virtue of their unique design, allow an optional number of increment charges to be transferred to the gun and the increment charges to be transferred directly from the charge magazine to the gun in a single operation. Personnel can obtain the desired ballistic protection against enemy fire and protection against poor weather by being positioned in the gun cabin. The increment charges can likewise be protected against poor weather by the fact that advancements of the various increment charges take place inside the magazine and that the magazine is provided with sealable units which are opened only upon the departure of the charge to the loading tray of the gun. The invention also comprises fixed, clear feed-in and feed-out functions of the increment charges to and from the charge magazine.

LIST OF FIGURES

Figure 2:
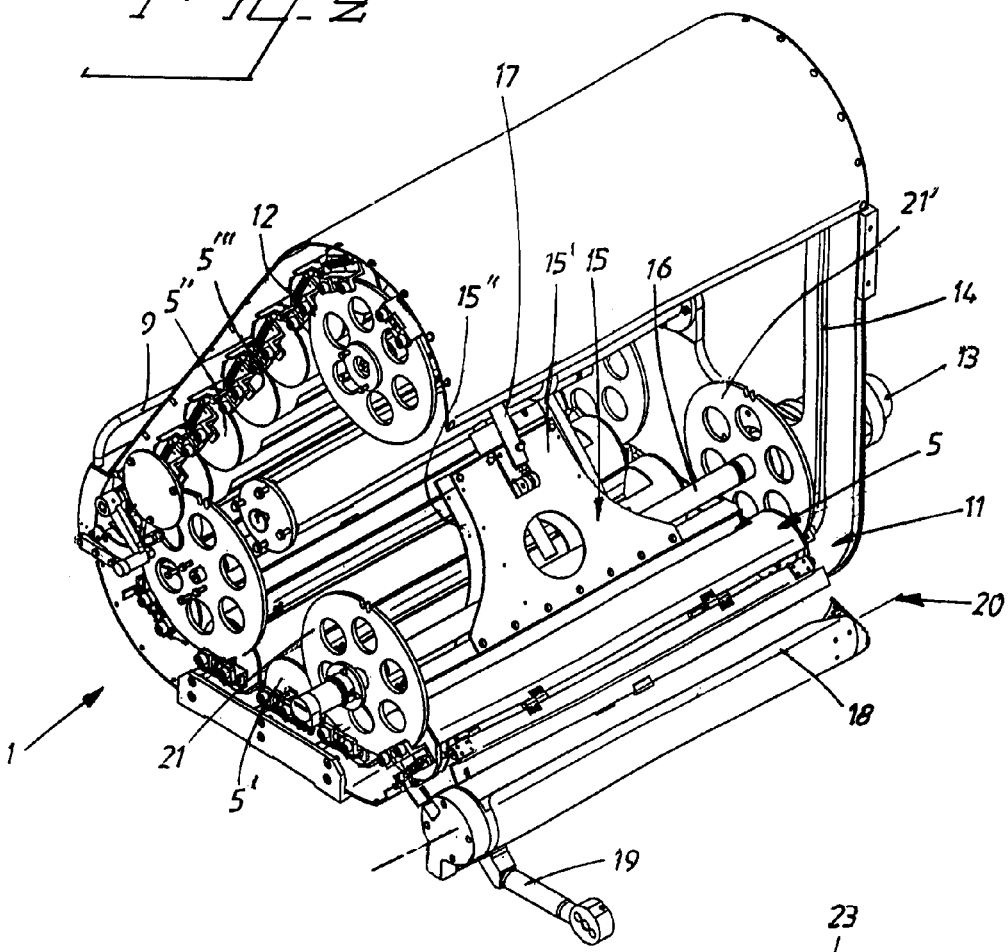
Figure 3:
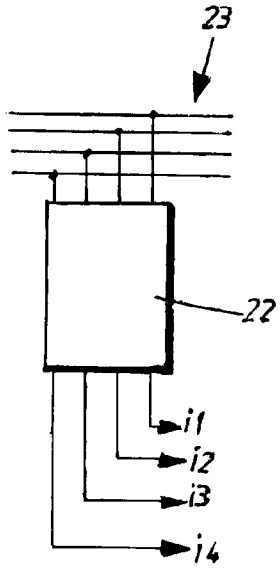
Figure 4:
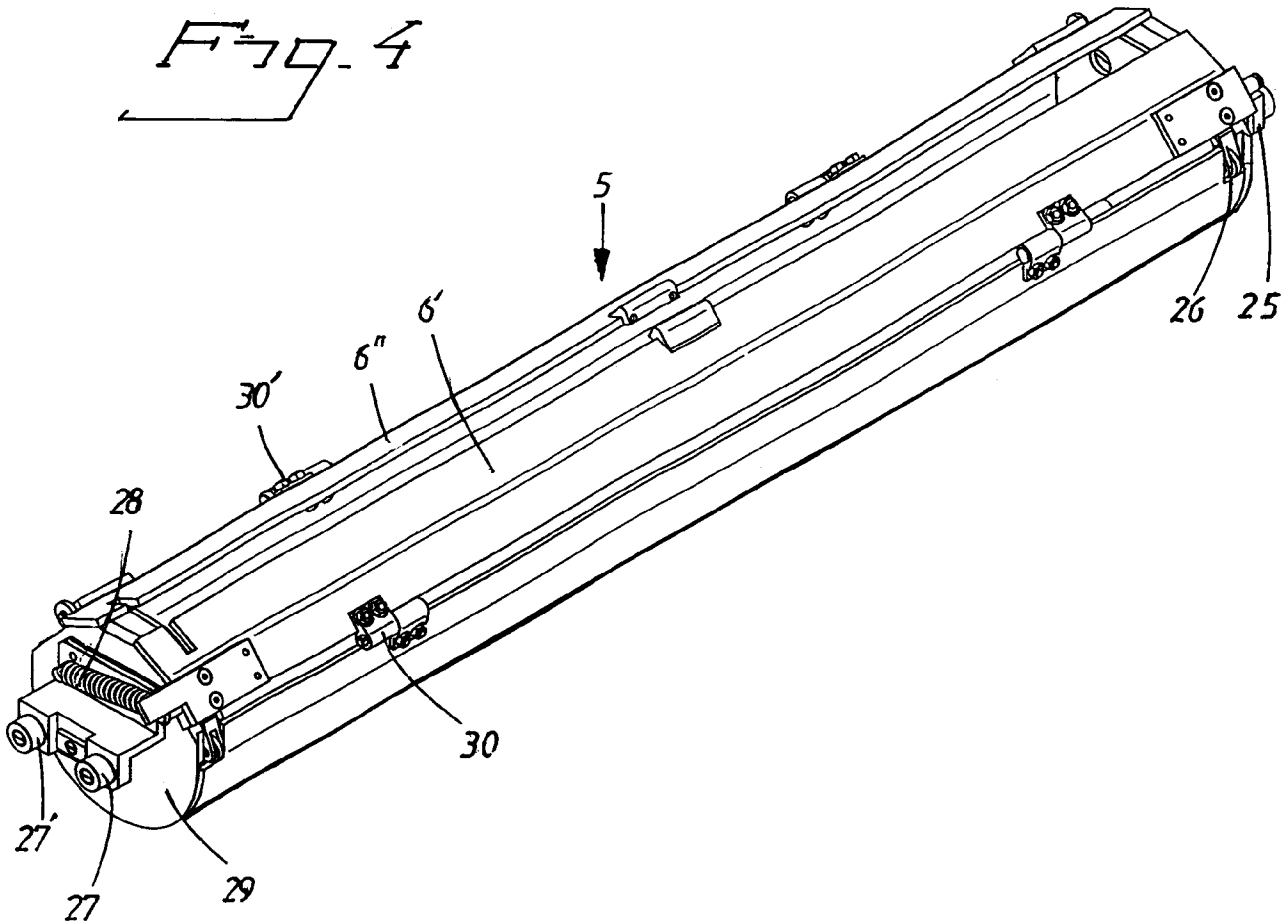
Figure 5:
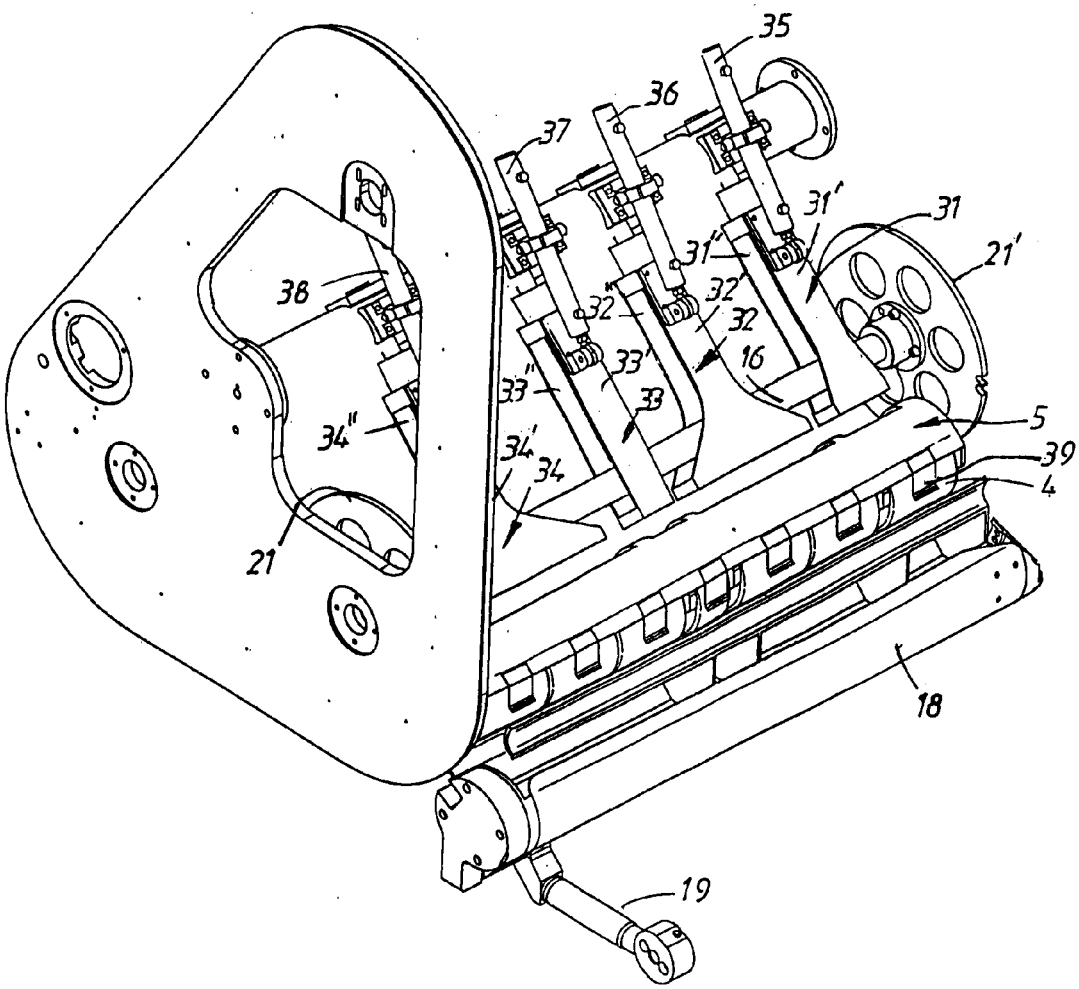
Figure 6:
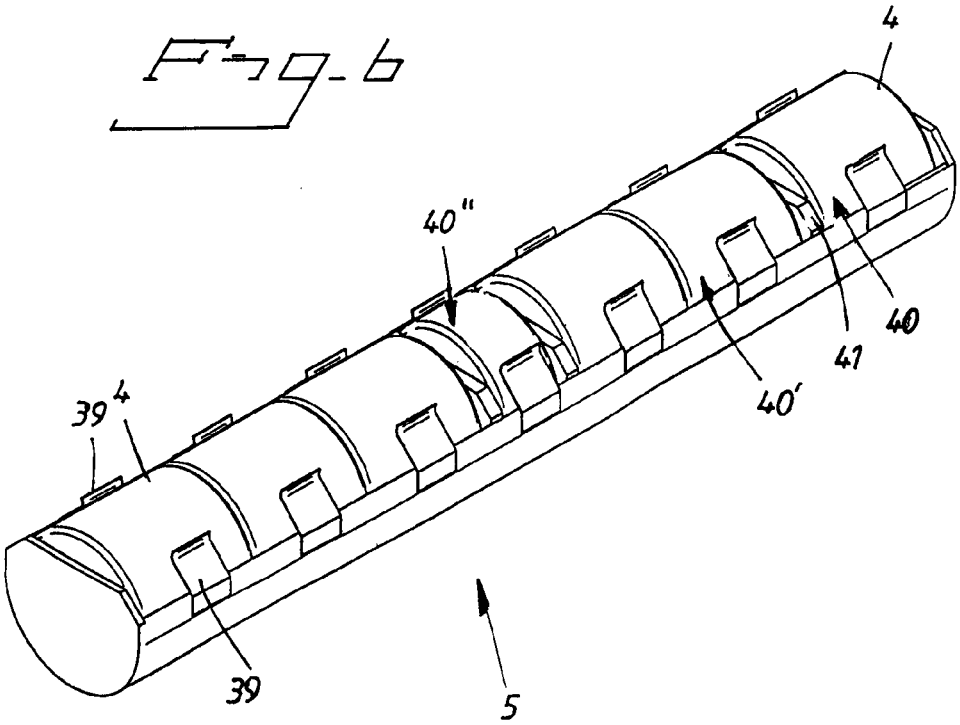
Figure 7:
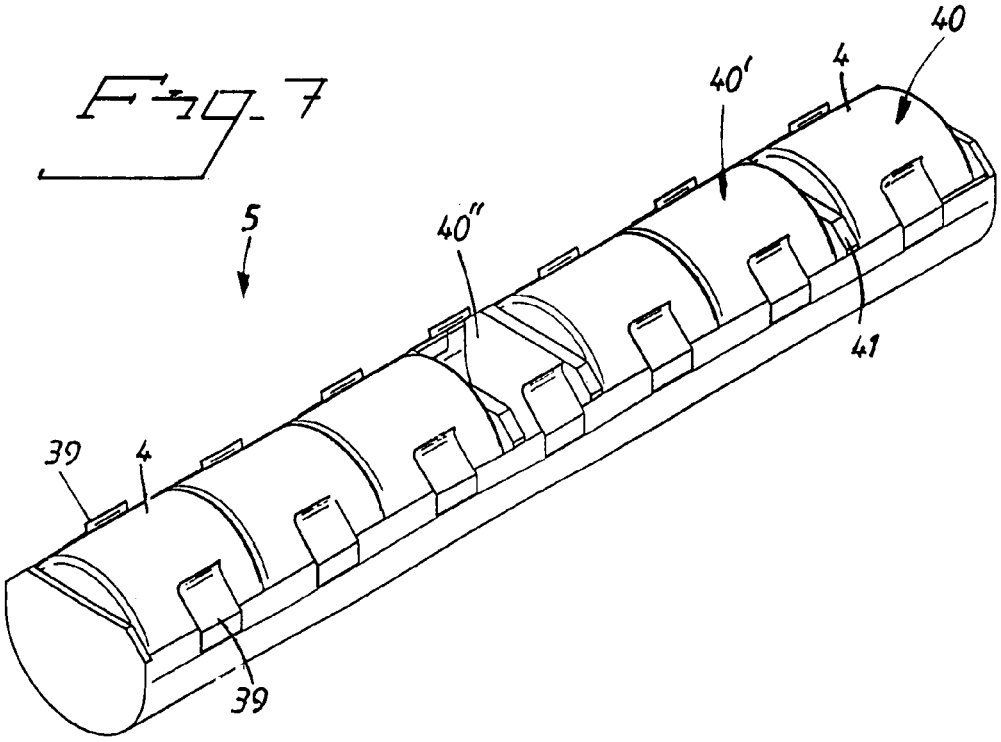

A currently proposed embodiment of a device having the characteristics indicative of the invention shall be described below with simultaneous reference to the appended drawings, in which:

FIG. 1 shows the charge magazine from its feed-in side viewed obliquely from above, with the feed-in hatch open for the feed-in of increment charges, FIG. 2 shows a first embodiment of the charge magazine in cross section viewed obliquely from above from its feed-out side, arranged with an ejection device for ejecting the increment charge(s) to the loading tray of the gun, FIG. 3 shows schematically the coupling between the internal control network of the gun and control devices for controlling the various functions of the charge magazine, FIG. 4 shows a first embodiment of a charge container viewed obliquely from above, arranged for one or more increment charges, FIG. 5 shows a second embodiment of a charge magazine in cross section viewed obliquely from above from its feed-out side, arranged with four ejection members for ejecting one or more increment charges to the loading tray of the gun, FIG. 6 shows the underside of a second embodiment of a charge container viewed obliquely from above, arranged for a plurality of increment charges, FIG. 7 shows an alternative embodiment to the embodiment according to FIG. 6.

DETAILED DESCRIPTION

FIG. 1 shows a first embodiment of a charge magazine 1 from the feed-in position 2 of the charge magazine 1. The charge magazine 1 is arranged at the feed-in position 2 with an openable and closable feed-in hatch 3, on which one or more propellent charges 4, also termed increment charges, can be applied. The feed-in hatch 3 is here arranged to hold at least one increment charge 4 in a predetermined position.

The applied increment charges 4 are intended to be shifted into a charge container 5 by closure of the feed-in hatch 3, this being described in greater detail below. The charge container 5 is provided with an openable and closable charge hatch 6.

In FIG. 1, the charge container 5 is shown with open charge hatch 6, so that the increment charge 4 or increment charges can be parallel-shifted into the charge container 5. The charge magazine 1 is provided on its outer side with an operating arm arrangement 7 for controlling the feed-in hatch 3 and the charge hatch 6.

The charge magazine 1 comprises a sensor for indicating a closed charge container 5. When the feed-in hatch 3 is actuated into the closed position, the increment charge 4 or increment charges are parallel-shifted into the charge container 5, whereafter the feed-in hatch 3 and the charge hatch 6 are assigned the closed position. The feed-in hatch 3 is provided with a handle 9 and a securing device 10.

In FIG. 2, the charge magazine 1 is shown from a feed-out position denoted by 11. A charge container 5 is set in this feed-out position 11. From FIG. 2 it can be seen that a number of further charge containers are arranged, together with the charge container 5, in a revolving track (partially shown) for the charge containers. Four of the charge containers have been provided with reference notations, three charge containers having acquired the notations 5', 5" and 5'". The number of charge containers 5 in the revolving track is preferably between 10 and 25 units. In the illustrated case, 18 charge containers 5, 5', etc. are arranged in the revolving track. The charge containers 5, 5', etc. are driven round in the revolving track with the aid of a chain conveyor, the chain of which is marked with 12, and a hydraulic motor 13.

The charge containers 5, 5' etc. are arranged guidably in a groove 14 on the inner wall of the charge magazine 1, more specifically on the inner end faces of the magazine 1 where the respective set of grooves extends round so that pins or studs can run in the grooves so that the charge containers are in this way guided in the revolving track. The charge magazine 1 also comprises at least one ejection member 15, with which the increment charge 4 or increment charges in the charge container set in the feed-out position 11 are ejectably arranged.

The ejection member 15 consists of two parallel ejection parts 15' and 15", which straddle a shaft 16 extending between the end walls of the charge magazine 1 parallelly with, inter alia, the charge containers 5, 5', 5".

The two ejection parts 15' and 15" straddle the said shaft 16 and are displaceable in their longitudinal directions from the position shown in FIG. 2 down into the interior of the charge container 5, where interaction takes place with one or more accompanying increment charges 4 (not shown). The charge hatch 6, see FIG. 1, on the charge container 5 is in this case open, so that the ends of the ejection parts 15' and 15" gain entry into the charge container 5.

The longitudinal displacement movement from the position shown in FIG. 2 into a position in which the increment charge 4 or increment charges are ejected from the charge container 5 is achieved with a hydraulic cylinder 17. The ejection of the increment charges from the charge container 5 takes place counter to the action of bracing members on the underside of the charge container 5, which is essentially placed opposite to the opening via which the ejection parts 15' and 15" gain entry. The ejection is realized from the charge container 5 down into the loading tray 18 of the gun.

After the loading tray 18 has been filled with one or more charges, the loading tray 18 swings with the aid of a swivel arm 19 into a position in which the longitudinal axis 20 of the loading tray, following transport, coincides with the longitudinal axis of the artillery gun (not shown). In the illustrated case, ejection of the increment charge or increment charges takes place via opened charge hatches 6 of the respective charge container 5, which charge hatches 6 form part of the control system of the respective increment charge 4.

The loading tray 18 is realized in an open construction, but can in an alternative embodiment also be realized in an openable and shuttable arrangement. The shaft 16 is mounted in the end faces of the charge magazine 1 and is provided with 2 chain wheels or gearwheels 21 and 21'.

The various parts of the charge magazine 1 are controllable with a control unit 22, which forms part of the internal control network of the gun, symbolized by 23 in FIG. 3. The control unit 22 can be constituted by a type which is known per se and reference is here made to the prior art in connection with artillery guns and other types of firearms. The said control unit 22 thus controls the driving of the revolving track for adjustment of the respective charge container 5, 5', 5", 5'" into the said feed-in and feed-out positions 2, 11. One or more control signals can here exist.

The control unit 22 is also arranged to control the ejection members 15, 31, 32, 33, 34 for the ejection of one or more increment charges 4 from the respective charge container 5, 5', 5", 5'". Control signals for these control systems are denoted by i2. The control unit 22 is also arranged to provide control systems which choose the type and/or content and/or quantity of the increment charge in the various charge containers 5, 5', 5", 5'". Signals for these control systems are in FIG. 3 denoted by i3.

Charge containers which are to be placed in the feed-out position 11 in a certain sequence in the firing of shells or equivalent due to have simultaneous impacts are designated with signals i4. The arrangement comprising the openable and closable hatches can be controlled mechanically. The application of the control functions to the various controllable parts of the charge magazine can be realized in a manner which is known per se.

In FIG. 4, the charge container 5 is shown in a detailed realization. The charge container 5 is provided with a charge hatch 6 consisting of two interlockable hatch parts 6, 6" and can fully enclose the increment charge 4 or increment charges and thereby provide protection against external influence, such as rain, for example. The charge container 5 is operated via a link 25 to an operating arm in a control arrangement 7, according to the above. The hatch halves 6', 6" are kept closed with the aid of the bias from two springs 28, arranged in the end faces of the charge container 5. The linkage from the said operating arm actuates the charge holder 5 so that this opens its hatch halves 6', 6". The movement of the charge container 5 in the revolving track is guided in the aforementioned grooves 14 on the inner sides of the magazine with the aid of two guide studs 27, 27' arranged on one end face of the charge container 5. The hatch halves 6', 6" are openable by virtue of the fact that they are rotatably arranged on fixedly mounted hinges on the long sides of the charge container 5. Opening and closing of the hatch halves 6', 6" is controlled under the influence of a bracing spring 28, which is fixedly mounted between one of the hatch halves 6' 6" and one of the end faces 29. The inner sides of the hatches 6', 6" can act as in the aforementioned control system in the transfers of the increment charge or increment charges to the loading tray 18.

As is shown in a second embodiment, according to FIG. 5, a plurality of ejection members 15, 31, 32, 33, 34 can be arranged to straddle the shaft 16.

This case is utilized when the charge container 5 placed in the feed-out position comprises a number of increment charges arranged together with one another, and only a limited number of these are to be ejected from the charge container 5 down into the loading tray 22 of the gun. In this case, the interior of the charge container 5 is divided into a number of compartments along its longitudinal extent, and on the underside the charge container 5 can be provided with a corresponding number of hatch parts which are held in place with leaf springs 39 or clips. Alternatively, the leaf springs 39 interact directly with the increment charges.

The ejection members 15, 31, 32, 33, 34 can be controlled individually with hydraulic cylinders 35, 36, 37, 38. This control can be realized from the control unit 22 in FIG. 3. Through the action of the various ejection members, different numbers of increment charges in the different compartments can be ejected from the charge container 5.

FIG. 6 shows a detailed realization of the interior of the charge container 5 in FIG. 5. The interior of the charge container 5 is in principle divided into seven different compartments, two compartments having been denoted by 40 and 40'. The compartments are separated with partition parts 41. As is shown in FIG. 6, one of the compartments 40" is arranged to receive an increment charge of half length in relation to other increment charge lengths. The increment charges are held in place with bracing springs 39 on opposite sides of the respective increment charge 4, a pair of bracing springs 39 being arranged on the respective compartment. The ejection devices eject the increment charges 4 from the charge container 5 under the influence of the resistance from the said bracing springs 39.

FIG. 7 shows a variant of the interior of the charge container 5 according to FIG. 6. In this case, no half-length increment charges are utilized, so that compartment 40" is empty.

Alternative or supplementary increment charges can be constituted by powder bags. Various modules of increment charges can be utilized. A packeted increment charge or packeted increment charges is/are advantageous in poor weather conditions. The increment charges can be packeted in various numbers, for example two, three or four increment charges, a variety of combustible packing materials being able to be used, for example paper or plastic.

The modules are used for different compositions in order to give different muzzle velocities of the projectiles, shells, etc. In the different module systems, different lengths and different contents are thus available. Reference can thus be made to the Bofors UniFlex 2 system, which gives 12 different muzzle velocities from 315 to 960 m/s.

The shells can be arranged in a further magazine, the charge magazine for shells and for increment charges being arranged on both sides of the loading tray of the gun. The further magazine, too, can be given a protected position on the gun and can be constructed similarly to or differently from the increment charge magazine.

The invention is not limited to the above examples, but rather can be subject to modifications within the scope of the following patent claims.

The invention claimed is:

1. Automatic charge magazine for storage and handling of propellant powder increment charges for projectiles, which are arranged in a fireable manner, together with the increment charges, in an artillery gun wherein the charge magazine comprises a plurality of charge containers arranged in a drivable revolving track, which charge containers are arranged to assume feed-in and feed-out positions for the feed-in and feed-out of at least one increment charge to and from the charge containers, and wherein the charge magazine is provided with a control unit arranged firstly to actuate the driving of the revolving track for adjustment of the respective charge container to the said feed-in and feed-out positions, and secondly to determine the current charge content in the respective charge container, wherein the charge magazine also comprises at least one ejection member, which ejection member, in response to control signals from the said control unit, ejects the at least one increment charge from the respective charge container, applied in the feed-out position, to a loading tray belonging to the gun, and wherein the charge magazine is arranged with openings situated on both sides of the charge magazine, and wherein the feed-in and feed-out positions for the charge containers are arranged at said openings.

2. Automatic charge magazine according to claim 1, wherein control signals are chosen to give increment charge contents to different projectiles arranged in a fireable manner in the gun in order that different projectiles reach an impact area at essentially the same time, despite the fact that the gun fires the projectiles during successive time intervals.

3. Automatic charge magazine according to claim 1, wherein the respective charge container is arranged with an openable and closable first opening, which, when the charge container is applied in the feed-in position of the charge magazine, is essentially directed upwards to enable the at least one increment charge to be deposited in the charge container.

4. Automatic charge magazine according to claim 3, wherein the respective charge container is arranged, when the at least one increment charge are fed out from the charge container to the loading tray of the gun, to have an opening facing towards the loading tray, which opening comprises a second opening arranged on the opposite side to the first opening.

5. Automatic charge magazine according to claim 4, wherein the ejection members, in the feed-out position of the charge container, are interactable with the at least one increment charge for parallel displacement from the charge container down into the loading tray.

6. Automatic charge magazine according to claim 5, wherein the displacement of the at least one increment charge is realized via at least one openable hatch or under the influence of bracing members.

7. Automatic charge magazine according to claim 1, wherein the feed-in position is situated in a protected part of the gun and/or in that the feed-out position is situated in an unprotected part of the gun, and wherein the respective charge container is provided with a charge hatch, comprising openable and closable hatch parts.

8. Automatic charge magazine according to claim 1, wherein the control unit is arranged, when shells are fired, to preselect charge containers in the revolving track and the charge containers' given turn for adjustment to the feed-out position.

9. Automatic charge magazine according to claim 1, wherein the revolving track comprises a chain conveyor and drive devices comprising a hydraulic motor.

10. Automatic charge magazine according to claim 5, wherein the respective ejection member comprises a hydraulic cylinder which ejects at least part of the increment charge with a longitudinal movement directed perpendicular to the longitudinal extent of the increment charge.

11. Automatic charge magazine according to claim 10, wherein the respective ejection member comprises two substantially parallelly arranged ejection parts which straddle a center shaft between two gearwheels disposed in the magazine, and wherein the center shaft is parallel with the longitudinal extent of the feed-out opening.

12. Automatic charge magazine according to claim 1, wherein the respective charge container assumes its feed-out position with an angle transmitter.

13. Automatic charge magazine according to claim 1, wherein devices controlling the revolving track are arranged such that they are interactable with grooves on the end faces of the charge magazine.

14. Automatic charge magazine according to claim 1, wherein the respective charge containers are arranged with two hatch halves, which assume open positions by virtue of the fact that they are actuated backwards along the envelope surface of the charge container counter to the action of a spring and are rotated about hinges, and wherein a link mechanism is arranged between the hatch halves and ensures that the hatch halves are opened simultaneously and synchronously.

15. Automatic charge magazine according to claim 14, wherein the link mechanism is provided with an operating arm disposed on an outer side of the magazine.

16. Automatic charge magazine according claim 1, wherein a feed-in hatch is disposed at the feed-in opening of the magazine, and wherein the feed-in hatch is provided with a manually actuable portion.

17. Automatic charge magazine according to claim 16, wherein, when the feed-in hatch is lowered, the feed-in hatch is arranged to receive the at least one increment charge, and wherein the hatch halves are here arranged such that they are openable by means of the said operating arm, whereafter the at least one increment charge can be manually shoved in by means of parallel movement (s) or by means of the hatch when this is actuated into the closed position.

18. Automatic charge magazine according to claim 1, wherein the interiors of the charge containers are arranged with assignable compartments situated side by side in the longitudinal directions of the charge containers, wherein the ejection members see to it that the correct number of increment charges are selected for further shots.

19. Automatic charge magazine according to claim 18, wherein one or more charge containers are arranged with a first compartment corresponding to a first length of an increment charge and a second compartment corresponding to a second length of an increment charge.

* * * * *